US006245248B1

(12) United States Patent
Mou

(10) Patent No.: US 6,245,248 B1
(45) Date of Patent: Jun. 12, 2001

(54) METHOD OF ALIGNING A NOZZLE PLATE WITH A MASK

(75) Inventor: Michael Mou, Taipei Hsien (TW)

(73) Assignee: DBTEL Incorporated, Taipei Hsien (TW)

( * ) Notice: Subject to any disclaimer, the term of this patent is extended or adjusted under 35 U.S.C. 154(b) by 0 days.

(21) Appl. No.: 09/184,441

(22) Filed: Nov. 2, 1998

(51) Int. Cl.[7] ..... G01D 15/00
(52) U.S. Cl. ..... 216/27; 216/85
(58) Field of Search ..... 347/1, 47, 45; 216/2, 27; 438/52

(56) References Cited

U.S. PATENT DOCUMENTS 5,368,683 * 11/1994 Altavela et al. ..... 156/633
5,658,471 * 8/1997 Murthy et al. ..... 216/27
5,665,249 * 9/1997 Burke et al. ..... 216/2
5,932,799 * 8/1999 Moles ..... 73/53.01
6,022,482 * 2/2000 Chen et al. ..... 216/27

FOREIGN PATENT DOCUMENTS

335506 * 7/1998 (TW) ..... H01L/21/02

* cited by examiner

*Primary Examiner*—Randy Gulakowski
*Assistant Examiner*—Michael Kornakov
(74) *Attorney, Agent, or Firm*—Rosenberg, Klein & Lee

(57) ABSTRACT

A method of aligning a nozzle plate with a mask, used for aligning a plurality of nozzles on the nozzle plate with a plurality of layouts on the mask, wherein each nozzle is defined between two nozzle positioning marks, the nozzle plate is provided with a film thereon, and the mask has a plurality of layouts defined between two layout positioning marks, including steps of: selecting two of the nozzle positioning marks, removing portion of the film above the two nozzle positioning marks with a chemical agent, arranging the mask on the nozzle plate, and moving the mask so as to make the two nozzle positioning marks each align with a respective one of layout positioning marks.

2 Claims, 4 Drawing Sheets

METHOD OF ALIGNING A NOZZLE PLATE WITH A MASK

BACKGROUND OF THE INVENTION

1. Field of the Invention

This invention is related to an improved method of aligning a nozzle plate with a mask.

2. Description of the Prior Art

Ink-jet printers generally fall into two categories, i.e. the bubble type ink-jet printers and the piezoelectric ink-jet printers. For piezoelectric ink-jet printers, what we concern most is related to the method of how to align the nozzle plate with a film in the manufacture of print heads in an effective way.

In the structure of piezoelectric ink-jet printers, the ink cabin is made by first pressing seven layers of high molecular material to form a spacer and then processing the film with mask etching method. The nozzle plate is formed with a plurality of nozzles and the mask has corresponding layouts of ink cabins. As the mask is etched, each of the nozzles must be in alignment with an ink cabin so that the ink cabin layout of the mask must be accurately aligned with corresponding nozzles of the nozzle plate.

In order to make it easier for alignment, the nozzle plate and the mask must be provided with nozzle positioning marks and layout positioning marks respectively, wherein every four of the nozzle positioning marks and every four of the layout positioning marks define a nozzle and an ink cabin respectively. Each of the nozzle positioning marks and layout positioning marks is represented by a sign +. In other words, each nozzle positioning mark is defined between four marks + on the nozzle plate, and each ink cabin is also defined between four marks + on the mask. It is only required for the operator to align the mark + of the nozzle plate with the mark + of the mask. Of course, it is only necessary to align two marks +. However, it is recommended to align the marks + which have the largest distance therebetween, usually the marks + at two diagonal corners.

Referring to FIGS. 1 and 2, the nozzle plate 11 is formed with a plurality of nozzles 111 each having an ink cabin 17. The ink cabin 17 is produced by first aligning the layout positioning marks 132 with the nozzle positioning marks 112 and then etching the area 113 of the film 12 on the nozzle plate 111.

As a result, each of the nozzles of the nozzle plate 11 is formed with an ink cabin 17. As shown, the nozzle positioning mark 112 is arranged under the film 12 so that it is necessary to see through the film 12 when aligning the mask with the nozzle plate.

Referring to FIG. 3, the conventional film 12 is made by pressing three layers of high molecular material which light can pass through, so that there will be no difficulties in aligning the mask with the nozzle plate. As shown in FIG. 3, the mask 13 is moved by a distance d in order to align the layout positioning mark 132 with the nozzle positioning mark 112 of the nozzle plate 11.

However, when required to increase the thickness of the film on the nozzle plate to a structure with seven layers, it will be very difficult to locate the nozzle positioning marks under the film.

Referring to FIG. 4, it is very difficult to see the nozzle positioning marks 112 of the nozzle plate 11 through a seven-layer film 12 thereby making it difficult to align the layout positioning marks 132 of the mask 13 with the nozzle positioning marks 112 thus seriously influencing the working efficiency.

Therefore, it is an object of the present invention to provide an improved method of a nozzle plate with a mask which can obviate and mitigate the above-mentioned drawbacks.

SUMMARY OF THE INVENTION

This invention is related to an improved method of aligning a nozzle plate with a mask, which utilizes a chemical agent to etch portion of the film on the nozzle plate to enable the nozzle positioning marks to be easily seen through an aligning machine thereby facilitating the alignment of the nozzle plate with the mask and therefore increasing the working efficiency.

The method of aligning a nozzle plate with a mask according to the present invention is used for aligning a plurality of nozzles on the nozzle plate with a plurality of layouts on the mask, wherein each nozzle is defined between two nozzle positioning marks, the nozzle plate is provided with a film thereon, and the mask has a plurality of layouts defined between two layout positioning marks, including steps of: selecting two of the nozzle positioning marks, removing portion of the film above the two nozzle positioning marks with a chemical agent, arranging the mask on the nozzle plate, and moving the mask so as to make the two nozzle positioning marks each align with a respective one of layout positioning marks.

According to the method of aligning a nozzle plate with a mask, the distance between a selected two nozzle positioning marks is larger than the distance between any other two of the nozzle positioning marks.

According to the method of aligning a nozzle plate with a mask, the film is made by pressing together seven layers of high molecular material.

According to the method of aligning a nozzle plate with a mask, a chemical agent is applied to the film to etch a portion of the film above the selected nozzle positioning marks when the first four layers of seven layers of film are pressed onto the nozzle plate, and then again applied after the remaining three layers of film are pressed onto the nozzle plate.

According to the method of aligning an nozzle plate with a mask, the chemical agent is applied to the film so as to etch a portion of the film above the nozzle positioning marks when seven layers of the film are pressed onto the nozzle plate.

According to the method of aligning a nozzle plate with a mask, the chemical agent is propanone.

According to the method of aligning a nozzle plate with a mask, the chemical agent is sodium hydroxide.

According to the method of aligning a nozzle plate with a mask, the layouts of the mask are ink cabin layouts.

DETAILED DESCRIPTION OF THE PREFERRED EMBODIMENT

Figure 1:
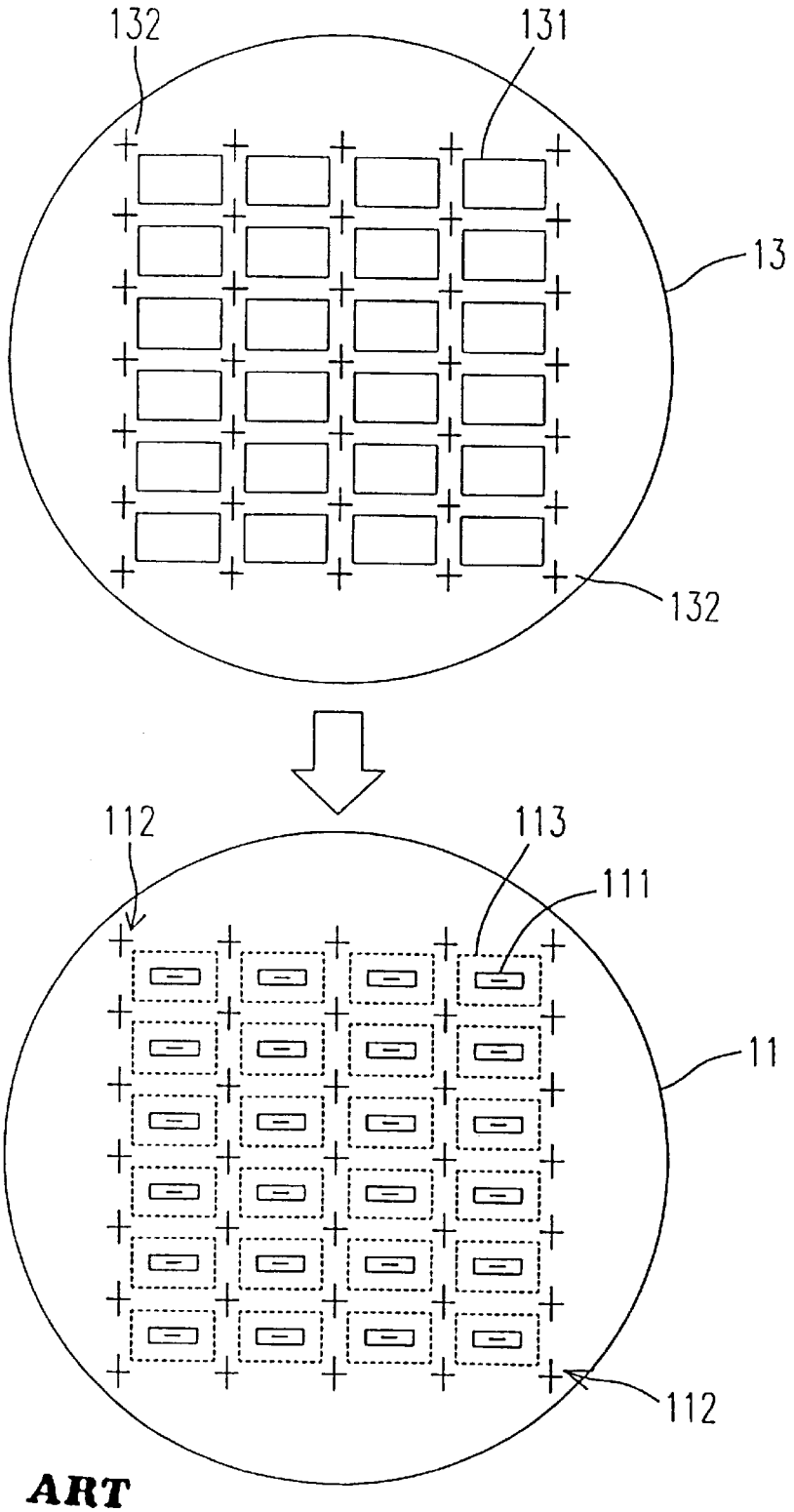
PRIOR ART FIG. 1
FIG. 1 illustrates a conventional method of aligning a nozzle plate with a mask.
Figure 2:
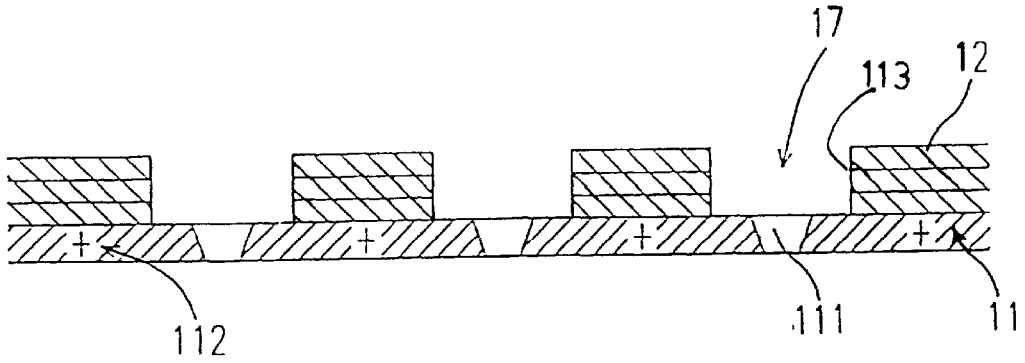
PRIOR ART FIG. 2
FIG. 2 illustrates how a film is formed with a plurality of ink cabins.
Figure 3:
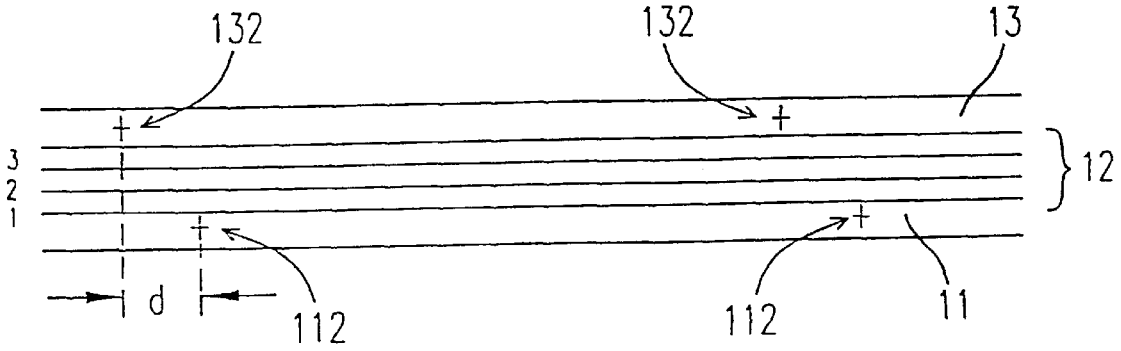
PRIOR ART FIG. 3
FIG. 3 illustrates the conventional method of aligning a three-layer film with a mask.
Figure 4:
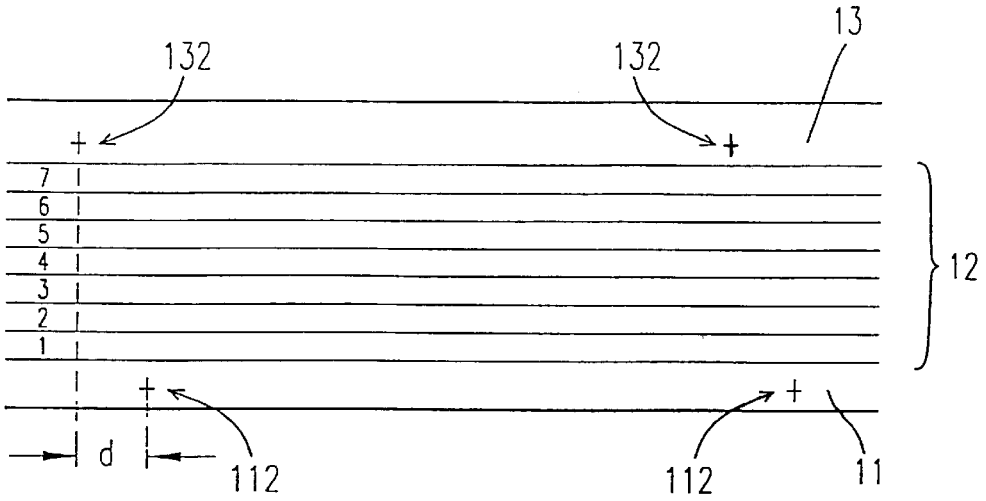
PRIOR ART FIG. 4
FIG. 4 illustrates a seven-layer film.
Figure 5:
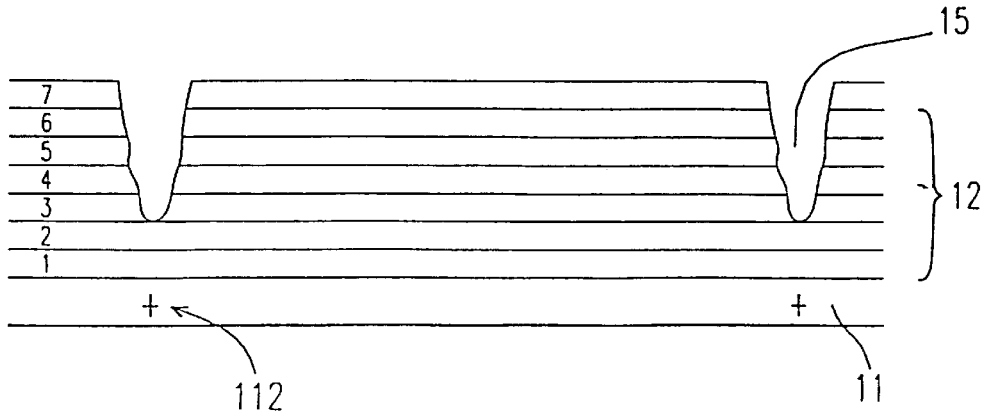
FIG. 5 illustrates how to form two cavities in the the seven-layer film according to the present invention.

With reference to the drawings and in particular to FIG. 5 thereof, a seven-layer film 12 is pressed on to a nozzle plate 11 by a film press machine (not shown) and two positioning marks 112 are made on the nozzle plate 11. Then, a small amount of chemical agent (such as propanone or sodium hydroxide) is applied to portions 15 by means of a dripping tube. Then, the portions 15 are removed by the chemical agent (only two portions of the film over a respective nozzle positioning mark are to be removed, and it is unnecessary to remove all other portions of the film over nozzle positioning marks). Then, a mask 13 is arranged on the film 12 so that the nozzle positioning marks 112 can be clearly seen through an aligning device (not shown) thereby increasing the efficiency in the aligning operation.

Figure 6:
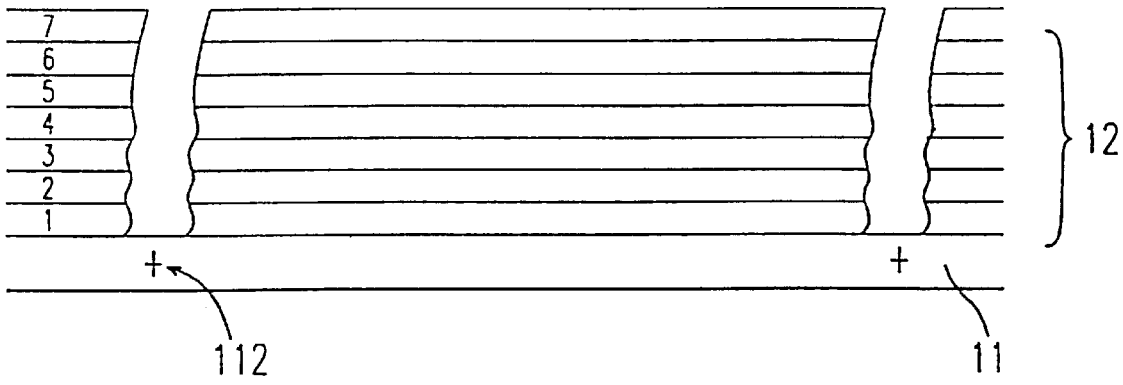
FIG. 6 illustrates a seven-layer film with the portions aligned with the positioning marks removed by two stages according to the present invention.

In order to remove the portions 15 in a more accurate way, the operation can be preceded in two stages. The portion is removed when the first four layers of the film are pressed together. Then, when the last three layers of the film are pressed together, the portion of the film is further removed, thereby obtaining the structure as shown in FIG. 6.

This invention is characterized in that the portions of the film for aligning with a mask is removed with a small amount of chemical agent before the mask is arranged on the film so that the operator can see the aligning marks 112 through an aligning device thereby increasing the production rate.

Accordingly, it would be helpful for aligning a nozzle plate with a multi-layer film with a mask before making ink cabins to apply a small amount of propanone or sodium hydroxide to etch the portion of the film right above the nozzle positioning marks on the nozzle plate, thereby facilitating the aligning operation and increasing the production rate.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. In a method of aligning a nozzle plate with a mask, said nozzle plate being provided with a plurality of nozzle positioning marks and formed with a plurality of nozzles defined between respective pairs of said plurality of nozzle positioning marks, said mask having a plurality of layout positioning marks and layouts, each layout being defined between a respective pair of said plurality of layout positioning marks, said method comprising steps of:

applying a plurality of layers of a light transmissive film to said nozzle plate;

selecting two of said plurality of nozzle positioning marks;

removing a portion of said film above each of said selected two nozzle positioning marks from each of said plurality of layers with a chemical agent for forming a pair of openings through said plurality of layers of said film;

arranging said mask on said plurality of layers of film above said nozzle plate; and moving said mask to align said selected two of said nozzle positioning marks with a respective pair of layout positioning marks through said pair of openings.

2. In a method of aligning a nozzle plate with a mask, said nozzle plate being provided with a plurality of nozzle positioning marks and formed with a plurality of nozzles defined between respective pairs of said plurality of nozzle positioning marks, said mask having a plurality of layout positioning marks and layouts, each layout being defined between a respective pair of said plurality of layout positioning marks, said method comprising steps of:

applying a first plurality of layers of a film to said nozzle plate;

selecting two of said plurality of nozzle positioning marks;

removing a portion of said film above each of said selected two nozzle positioning marks from each of said first plurality of layers with a chemical agent for forming a pair of first openings through said first plurality of layers of said film;

applying a second plurality of layers of said film to said first plurality of layers of said film;

removing a portion of said film above each of said selected two nozzle positioning marks from each of said second plurality of layers with a chemical agent for forming a pair of second openings through said second plurality of layers of said film, said pair of second openings being disposed in respective aligned relationship with said pair of first openings;

arranging said mask on said second plurality of layers of film above said nozzle plate; and, moving said mask to align said selected two of said nozzle positioning marks with a respective pair of layout positioning marks through said pairs of first and second openings.

* * * * *